United States Patent [19]

Bellinghausen et al.

[11] 4,092,641

[45] May 30, 1978

[54] SECURITY INTERLOCK SWITCH SYSTEM FOR SMOKE DETECTORS AND THE LIKE

[75] Inventors: Thomas A. Bellinghausen, Lakewood; Gareld I. Gilman, Indian Hills, both of Colo.

[73] Assignee: Statitrol Corporation, Lakewood, Colo.

[21] Appl. No.: 703,059

[22] Filed: Jul. 6, 1976

[51] Int. Cl.[2] ..... G08B 29/00

[52] U.S. Cl. ..... 340/409; 340/237 S; 340/237 R; 340/280; 200/61.03; 200/50 A

[58] Field of Search ..... 340/409, 237 S, 237 P, 340/276, 274, 280, 421, 237 R; 116/6; 312/234, 234.3; 200/61.03, 61.62, 61.67, 61.68, 61.69, 61.7, 61.71, 61.72, 61.73, 50 A

[56] References Cited

U.S. PATENT DOCUMENTS

| | | | |
|---|---|---|---|
| 2,346,171 | 4/1944 | Laford | 340/276 |
| 2,654,082 | 9/1953 | Cahusac | 340/409 |
| 3,440,636 | 4/1969 | Sliman | 340/280 |
| 3,451,369 | 6/1969 | Leve et al. | 116/86 |
| 3,588,866 | 6/1971 | Schlafly | 340/276 |
| 3,858,193 | 12/1974 | Bach | 340/164 R |

*Primary Examiner*—John W. Caldwell, Sr.
*Assistant Examiner*—Donnie L. Crosland
*Attorney, Agent, or Firm*—John E. Reilly

[57] ABSTRACT

Attempts to pilfer or tamper with condition detector structures such as smoke detectors, intrusion detectors or the like are discouraged by incorporating switch apparatus within the enclosure for the condition detector device. This switch is directly associated with the hardware required for attaching the housing to a wall, ceiling or other structure so that the normal condition alarm signal generated, such as, when smoke, intruders or other sensed conditions are present is simulated by the attempts at removal of the mounting hardware. The invention is particularly useful in conjunction with condition detecting devices having self-contained internal apparatus.

5 Claims, 6 Drawing Figures

SECURITY INTERLOCK SWITCH SYSTEM FOR SMOKE DETECTORS AND THE LIKE

BACKGROUND OF THE INVENTION

The present invention relates to novel and improved systems and apparatus for detecting an attempt to tamper with or remove the housing of a condition detecting apparatus. More particularly, the present invention relates to tamper-proof apparatus and systems for generating a detectable alarm in the presence of an unauthorized attempt to remove a condition detecting device from its normal mounting position. The present invention as will be described in detail in conjunction with a smoke detector is particularly useful for discouraging tampering or pilferage of smoke detectors or other self-containing alarm generating devices from their normal mounting environment.

The use of devices for sensing an abnormal condition such as smoke, intruders or the like for various environments including residential, commercial and other applications has come into increasing demand. This is especially true of smoke detectors as a result of the number of lives saved by generation of an audible warning alarm in the presence of a fire. Still further, the art of such smoke detectors has advanced to the point that self-contained and self-powered units are now generally available which devices do not require separate wiring to power sources or remote detector stations. Further, the mounting of such self-contained units in transient public facilities, such as motels, hotels and the like has become extensive in recent years. Unfortunately, the self-contained nature of these devices has rendered it relatively easy for theft or tampering with such devices without any means of detecting that such unauthorized efforts are in progress. Obviously such activities significantly reduce the life/safety protection available to occupants if allowed to go undetected.

Various efforts have been undertaken to provide warning signals when unauthorized removal of housings for different apparatus has occured. For instance, Whalen et al. U.S. Pat. No. 3,710,371 shows a mercury switch arrangement for triggering a silicon-controlled rectifier latching circuit to generate an alarm when an unauthorized removal attempt is made. Such mounting orientation dependent devices are not acceptable since devices such as smoke detectors may be mounted in any vertical or horizontal position.

Various other arrangements wherein plunger-type switches are actuated so as to generate an alarm have been suggested in the past. For instance, Kaplan U.S. Pat. No. 3,110,892 employs a plunger switch under the locking hasp of an enclosure so that any tampering with these hasps closes the plunger switches and actuates an alarm with the enclosure via powering from a battery pack likewise within the enclosure. Somewhat similar teachings are present in Bennett et al. U.S. Pat. No. 3,685,037 which suggests use of a separate box intended for placement beneath an item to be protected such as a typewriter or the like with an outwardly biased plunger so that removal of the weight of the typewriter or lifting of the box will close an alarm switch to actuate a buzzer contained within the housing. Yet another apparatus is shown in Bach U.S. Pat. No. 3,858,193 which generates an alarm for detection at a remote location by using a plunger switch arranged to abut an adjacent wall when the housing is screwed into the wall or mounting plate.

That is, removal of the housing from the wall releases the plunger and closes an alarm switch.

Unfortunately, the plunger type of alarm switch mechanism is defeated by relatively simple efforts such as by merely sliding a stiff ruler, card or the like between the wall or surface so that the device can be removed without detecting that it is not longer in its intended position. Therefore there has been a continuing need for a pilferage or tamper-proof detector apparatus and system which will reliably generate an alarm in a manner which cannot be easily defeated as is possible with the existing prior art devices.

SUMMARY OF THE INVENTION

In the present invention a switch is incorporated within an enclosure in such a manner that an alarm voltage will be reliably generated when the enclosure is removed from its intended mounting. Although not necessarily limited thereto, the present invention is particularly useful for supplying an internal switch function within a self-contained alarm detector so as to energize the alarm contained within the enclosure. Condition detector devices such as smoke detectors are typically mounted on a wall or on a mounting plate attached to a wall or ceiling. The present invention activates the mechanism for alarm generation when the apparatus for attachment to the wall or mounting plate is removed or loosened. Thus the self-contained alarm provides the dual function of indicating an audible alarm when the abnormal condition being sensed, such as smoke, intrusion or the like, is generated or when efforts to pilfer the device are made.

The preferred device of the present invention contains an alarm generator within a housing which is removably securable by a movable fastener either to a plate fixed to a surface or directly to the surface itself. A switch is capable of producing first and second electrical states, generally binary in nature, the switch being attached within the housing in an orientation for engagement by the movable fastener to cause the switch to produce a first output state when the positioning of the fastener is such as to secure the housing to the surface or the surface plate and to cause the switch to produce the second output state when the positioning of the fastener is such as to release the housing from the surface plate. The switch output is coupled to enable the alarm generator whenever the switch is allowed by the fastener to be in its second output state. As described in the exemplary preferred embodiment, the switch output can be used to couple into the alarm generator circuit so as to simulate the presence of the condition for which the alarm generator is actually designed thereby effecting a detectable alarm which is preferably audible in nature.

Accordingly, an object of the present invention is to provide a novel and improved structure and system for generating detectable alarms in the presence of unauthorized attempts to remove enclosures from their intended mounting.

A further object of the present invention is to provide a novel and improved apparatus and system for generating an audible alarm whenever an unauthorized attempt is made to remove an enclosure from its normal mounting on a wall, ceiling or other surface.

Another object of the present invention is to provide novel and improved apparatus and systems for generating a detectable alarm by simulating the existence of an alarm condition associated with the intended operation of a condition sensing device so that any attempt to remove the condition detector apparatus from its normal mountings is signaled to others.

A still further object of the present invention is to provide a novel and improved apparatus and method for causing a self-contained and self-powered alarm generator to produce an audible output signal whenever any attempt is made to remove the mounting hardware of the enclosure for this device from its intended mounting position.

The foregoing and other objects, features and advantages of the present invention will be more readily apparent in view of the subsequent detailed description of exemplary embodiments of the present invention taken in conjunction with the drawings.

DETAILED DESCRIPTION OF THE PREFERRED EMBODIMENT

Figure 1:
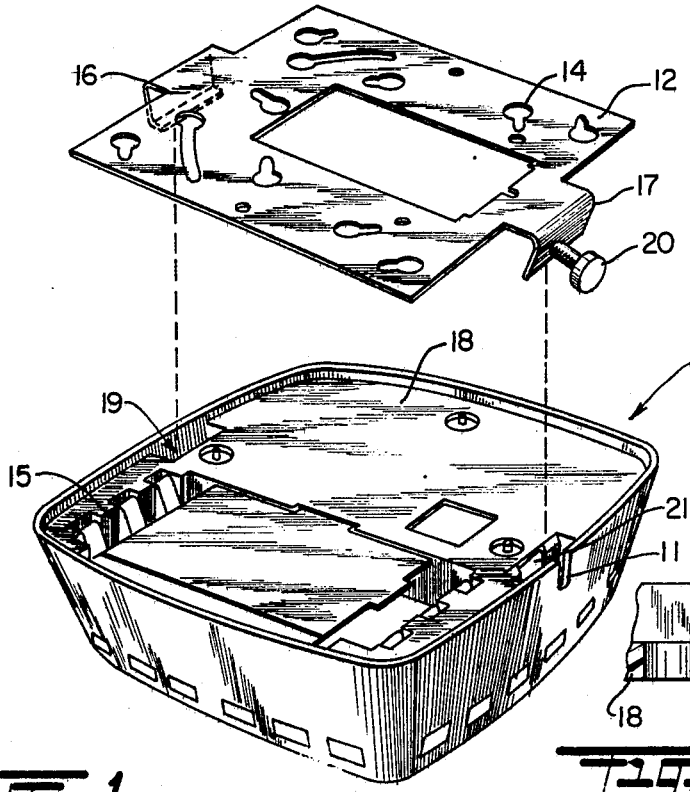
FIG. 1 is a perspective view of a self-contained alarm detector housing showing its interrelationship with a typical mounting plate.

There is shown by way of illustrative example in FIG. 1 a perspective view of a self-contained smoke detector unit 10 and a surface mounting plate 12 releasably attached thereto. The self-contained detector unit 10 typically may include a model 800A or 900A condition detector device produced by the Statitrol Corporation of Lakewood, Colorado, although other condition-sensing apparatus may be used such as the models 700 and 770 of the same manufacturer. Typically, such devices are either directly screw-mounted onto walls, ceilings or other surfaces or are fastened through the intermediary of mounting plates such as 12. As is well known, such mounting plates broadly include various screw-mounting slots such as 14 which when directly attached to another surface are covered by the housing of the detector assembly 10. Condition detector devices which are self-contained for generating an audible alarm typically have their own internal power supplies and for this purpose the device 10 includes a bay or mounting arrangement for batteries as represented at cavity 15.

Figure 2:
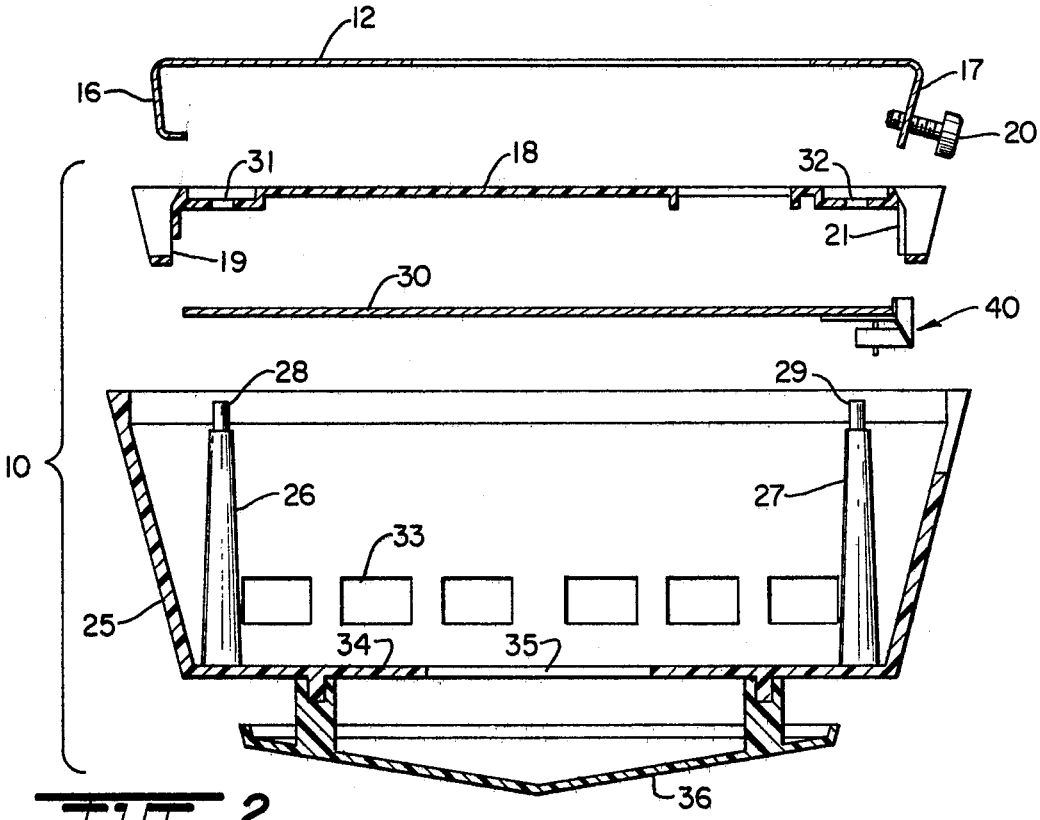
FIG. 2 is an exploded and sectioned view of the elements shown generally in FIG. 1.

The structure of FIG. 1 is shown in greater detail in the exploded section view of FIG. 2 wherein downwardly directed, inwardly inclined hooks 16 and 17 of mounting plate 12 are shown as being attachable to an intermediate connecting plate 18 wherein the hook 16 is inserted into slot 19 on one side of plate 18 and the hook 17 is then passed downwardly until screw 20 can be advanced into a slot 21 on the opposite sidewall of plate 18.

Unit 10 is formed with an outer generally cup-shaped housing 25 molded as a single part with a pair of upstanding posts 26 and 27 having upper pins 28 and 29 adapted to pass through aligned bores in a printed circuit board 30 and further through aligned bores 31 and 32 in the plate 18 so as to fasten the entire assembly together as a unit. Particularly when employed as a smoke detector, various slots or recesses such as at 33 can be included throughout the sidewalls of the housing, and a center opening 35 extends through the bottom surface 34 of housing 25 to allow smoke to enter into the smoke detecting apparatus contained therein. A decorative and protective cover 36 is disposed in spaced relation beneath the housing to provide a gap for uninterrupted passage of smoke through the center opening 35 as is the case with the Statitrol Corporation manufactured models 800A and 900A mentioned above.

It will be understood that printed circuit board 30 includes all of the internal circuitry associated with the condition detecting apparatus including the smoke detector device itself and the alarm or horn type device with the powering thereof being provided by batteries inserted within compartment 15. These elements are well-known and thus have not been shown in detail in FIG. 2. However, a switch 40 is preferably attached to board 30 along one edge thereof as shown, the switch being aligned so as to be engaged by the attaching screw 20 in a manner hereinafter described.

Figure 3:
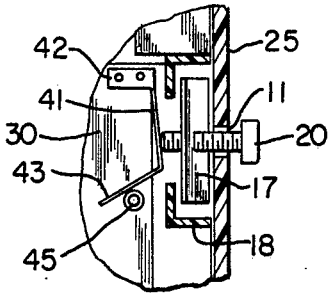
FIG. 3 shows a section view illustrating the interrelationship of the apparatus of FIGS. 1 and 2 in a normal wall mounted position.
Figure 4:
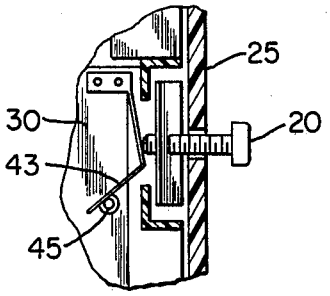
FIG. 4 illustrates the structure of FIG. 3 when the mounting hardware has been loosened so as to generate an alarm signal.

More particularly, FIG. 3 shows the positioning of switch unit 40 including a spring contact arm 41 attached to the side edge of board 30 by a flat plate 42 so as to incline outwardly as at 42 from the edge of the board 30 then to incline or return inwardly in the form of an angled extension 43 substantially at 90° to the arm 42. The outer extension 43 of arm 41 is arranged so as to normally be out of electrical conductive contact with a fixed contact defined by upstanding post 45 when screw 20 is fully inserted as shown in FIG. 3. Thus, when the mounting screw 20 is even slightly withdrawn from its normal position for attaching the housing enclosure 10 on the mounting plate 12, as shown in FIG. 4, arm portion 43 is biased to move into electrical contact with post 45 thereby simulating the existence of the alarm condition for the detector structure contained within housing 10 whereby to generate an audible alarm even before it is possible to remove enclosure 10 from plate 12.

Figure 5:
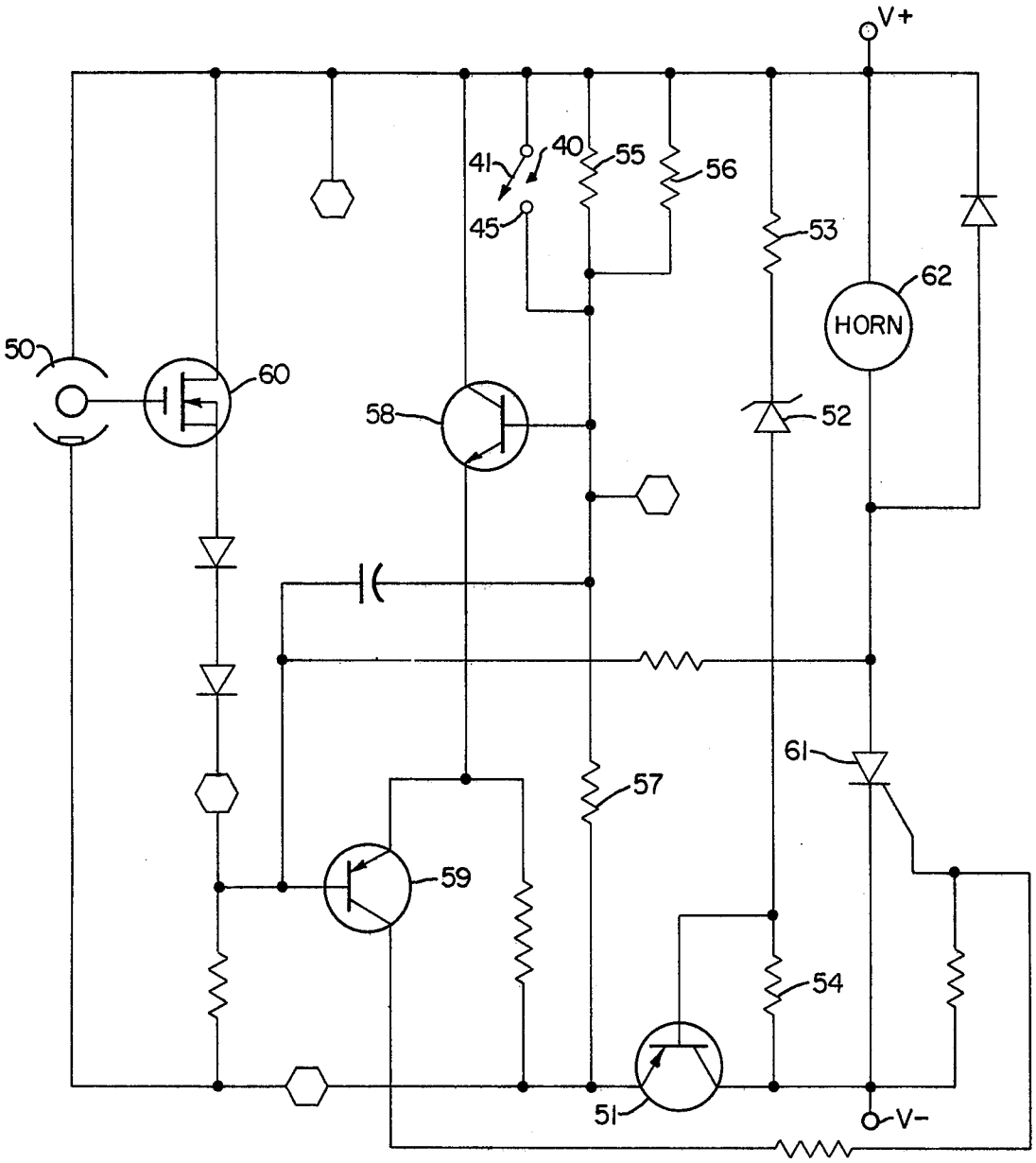
FIG. 5 is a schematic diagram of the elements contained within a self-contained alarm detector showing the interrelationship of the alarm switch.

The interrelationship of the pilferage detecting switch with the self-contained alarm system of enclosure 10 is shown in the electrical schematic of FIG. 5. A conventional smoke detector element 50 is enabled by voltage applied to the terminals indicated at V+ and V− as enabled by a conventional voltage regulator transistor 51. In turn, regulator transistor 51 is enabled by zener diode 52 coupled through resistors 53 and 54 between the DC input at the voltage terminals V supplied by the battery [not shown]. Resistors 55, 56 and 57 define a voltage divider for the emitter follower transistor 58. Transistor 58 sets the voltage applied to the emitter of the voltage switch transistor 59. With the regulated voltage applied to the uni-junction transistor type device 60 which might typically be a 40468A or SFE616, the ion chamber detector 50 biases semiconductor device 60 "on" enough to reverse bias transistor 59 into the "off" state. In normal operation, smoke entering the chamber 50 causes semiconductor 60 to be biased "off" enough to turn semiconductor 59 "on" and therefore bias silicon-controlled rectifier 61 into conduction. This energizes the audible horn 62 to generate an alarm.

The switch arm 41 and contact 45 associated with the mounting hardware is shown in its normally open position when enclosure 10 is fully mounted on plate 12 thus causing an open space to exist. Under these circumstances, the normal smoke operation as discussed above is effected. However, once the screw 20 is partially released, switch arm 41 closes thus shorting resistors 55 and 56 and causing semi-conductor 59 to gate SCR 61 "on" thereby energizing alarm horn 62. Note that alarm horn 62 will continue to sound after an initial contact has been made by the switch arm 41 since the only effective means of removing the conductive state from SCR 61 is by removal of operating power thereto. Thus, alarm 62 will continue to sound until intervention as by removal of the operating batteries.

Figure 6:
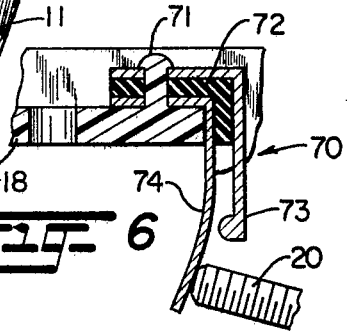
FIG. 6 shows a second embodiment of the switch mounting hardware useful in conjunction with the device shown generally in FIG. 1.

Various means of attaching the switch arm 41 so that it will be actuated by the enclosure mounting hardware can be employed. For instance, an alternate configuration is shown in FIG. 6 wherein upper plate 18 of enclosure 10 includes a switch assembly 70 attached to a post 71 as by swaging or the like. This switch assembly is formed of an insulating insert 72 between two electrical contact elements 73 and 74. Elements 73 and 74 are positioned such that screw 20 normally clears contact 73 but engages contact 74 so as to move it into the nonelectrical conductive contact position as shown in FIG. 6. Thus, when removal of screw 20 is even slightly effected, contacts 73 and 74 will electrically communicate so as to produce the same warning signal caused by the switch contacts 41, 45 discussed hereinbefore.

In a typical installation, the batteries which were described previously as incorporated within compartment 15 include an insulator between the electrical contacts which is flexible and accessible externally to housing 10 so that the assembly can be mounted without generating the alarm. The enclosure 10 is first engaged with plate 12 attached to the surface via hook 16 and pivoted into place. That is, housing 10 is pivoted over plate 12 so that screw 20 will be moved into slot 11 and hook or ear 17 moved downwardly until screw 20 can be inserted into the slot 21 of upper plate 18 in enclosure 10. When screw 20 has been completely secured, the warning switch will be opened as shown so that no alarm condition simulation will result. At that point, the insulating tab associated with the batteries within compartment 15 is removed and the entire system is enabled. Thereafter, any attempt to remove the enclosure 10 even by partially loosening screw 20 will result in generation of the alarm via horn 62 which cannot be stopped until the batteries have been removed. As anyone who has ever heard the audible alarm produced by horn such as 62 can verify the noise produced will require the attention of anyone in the general area and an investigation as to the circumstances of the removal. Of course, authorized removal of the enclosure 10 can be effected since the resultant alarm will not cause investigation or at least will be recognized as an authorized condition.

Although the present invention has been described with particularity relative to the foregoing detailed description of the exemplary preferred embodiments, various modifications, improvements, additions and applications other than those specifically mentioned herein will be readily apparent to those having normal skill in the art without departing from the spirit of this invention.

What is claimed is:

1. In a smoke detecting device for indicating an active alarm state, said device adapted to be mounted to a flat surface such as a wall, ceiling or the like, the improvement comprising:

a first mounting plate adapted to be secured in abutting relation to said flat surface, said first mounting plate having a plurality of mounting tabs projecting outwardly from said flat surface when said first mounting plate is secured thereto;

a generally cup-shaped housing adapted to be releasably secured to said first mounting plate to define an enclosed chamber therebetween;

a second mounting plate having a plurality of slots positioned to be aligned with said mounting tabs, said second mounting plate dimensioned to be mounted within said housing;

a circuit board disposed within said enclosed chamber adjacent to said second mounting plate on a side opposite said first mounting plate and having electrical output means for generating a signal indicative of said active alarm state;

mounting means on said housing for releasably securing said second mounting plate and said circuit board to said housing;

an electrical switch mounted on said circuit board adjacent to one of said slots when said circuit board is secured to said housing and having switch means for switching said output means into and out of said active alarm state; and a fastener for releasably securing said housing to one of said tabs, said fastener positioned to engage said switch means to switch said output means out of said active alarm state when said housing is secured to said one of said tabs, said switch means automatically switching said output means into said active alarm state when said fastener is moved out of engagement with said switch means.

2. A smoke detecting device according to claim 1, further including a plurality of guideposts attached to said housing and projecting toward said first mounting plate, said circuit board having a plurality of openings positioned to allow said guideposts to pass therethrough, said second mounting plate having attachment means on the surface thereof for attaching said guideposts to said second mounting plate, said guideposts operative to align said circuit board and said second mounting plate with said housing, a first one of said tabs having a flat lip portion positioned to engage a portion of said housing for securing said housing thereon and second one of said tabs having a threaded bore for receiving said fastener, said fastener being a screw dimensioned to pass through said bore and to engage said switch means.

3. In a device having an anti-tamper alarm generator circuit for signaling an active alarm state and having a housing structure adapted for mounting on a plate attached to a surface such as a wall or ceiling or the like, said plate having at least one mounting tab projecting toward said housing from adjacent an outer edge of said plate and provided with a fastener-receiving opening adapted to be aligned with a slot in a side wall of said housing structure, the improvement comprising:

a circuit board mounted within said housing structure and having output means for generating an electric signal indicative of said active alarm state;

an electrical switch mounted on said board having an outwardly disposed post member in perpendicular relation to said board and a contact arm resiliently biased in electrical contact with said post and operative to initiate said active alarm state when said post member and said contact arm are in electrical contact; and fastener means for releasably securing said housing structure to said plate, said fastener means including a locking screw positioned to extend through said slot and said fastener-receiving opening in said mounting tab and to engage said contact arm and to force said contact arm out of electrical contact with said post member when said housing structure is secured to said plate.

4. In a device according to claim 3, wherein said post member is an elongated rigid arm having an enlarged nub at the outwardly disposed end thereof, said contact arm being a leaf spring projecting in closely spaced relation to said rigid arm and biased for movement in a common plane with said rigid arm, said contact arm positioned to contact said nub.

5. In a device according to claim 3 wherein said contact arm is a leaf spring mounted on said circuit board to be normally in contact with said post member and movable in a direction substantially parallel to said circuit board.

* * * * *